United States Patent [19]

Kim

[11] 4,306,326

[45] Dec. 22, 1981

[54] WASHING, POLISHING AND SCRUBBING MOP

[76] Inventor: Kwan C. Kim, 133 Mauna Kea St., Hilo, Hi. 96720

[21] Appl. No.: 160,639

[22] Filed: Jun. 18, 1980

[51] Int. Cl.[3] ..... A47L 13/12; A47L 13/20

[52] U.S. Cl. ..... 15/105; 15/118; 15/229 A

[58] Field of Search ..... 15/105, 118, 119 R, 15/220, 229 R, 229 A, 229 B

[56] References Cited

U.S. PATENT DOCUMENTS

| | | | |
|---|---|---|---|
| 1,576,777 | 3/1926 | Moore | 15/229A |
| 1,643,878 | 9/1927 | Crouch | 15/228 |
| 1,676,880 | 7/1928 | Whitaker | 15/229 A |
| 3,135,002 | 6/1964 | Moss | 15/229 A |
| 3,246,356 | 4/1966 | Sorrells | 15/118 |
| 3,432,873 | 3/1969 | Moss | 15/118 |
| 3,750,218 | 8/1973 | Rosocha | 15/118 |
| 3,795,934 | 3/1974 | Moss | 15/118 X |
| 3,805,315 | 4/1974 | Moss | 15/229 A |

FOREIGN PATENT DOCUMENTS

| | | | |
|---|---|---|---|
| 1023751 | 12/1952 | France | 15/229 R |

*Primary Examiner*—Robert L. Bleutge
*Attorney, Agent, or Firm*—Nicolaas DeVogel

[57] ABSTRACT

A floor mop provided with an attachment carrying an abrasive pad on one side and a semi-abrasive pad on the other side of the mop swab. The pads are of rectangular shape and are connected to part of the mop strands in such a way that each pad remains flat and applies substantial equal pressure to a floor surface.

8 Claims, 8 Drawing Figures

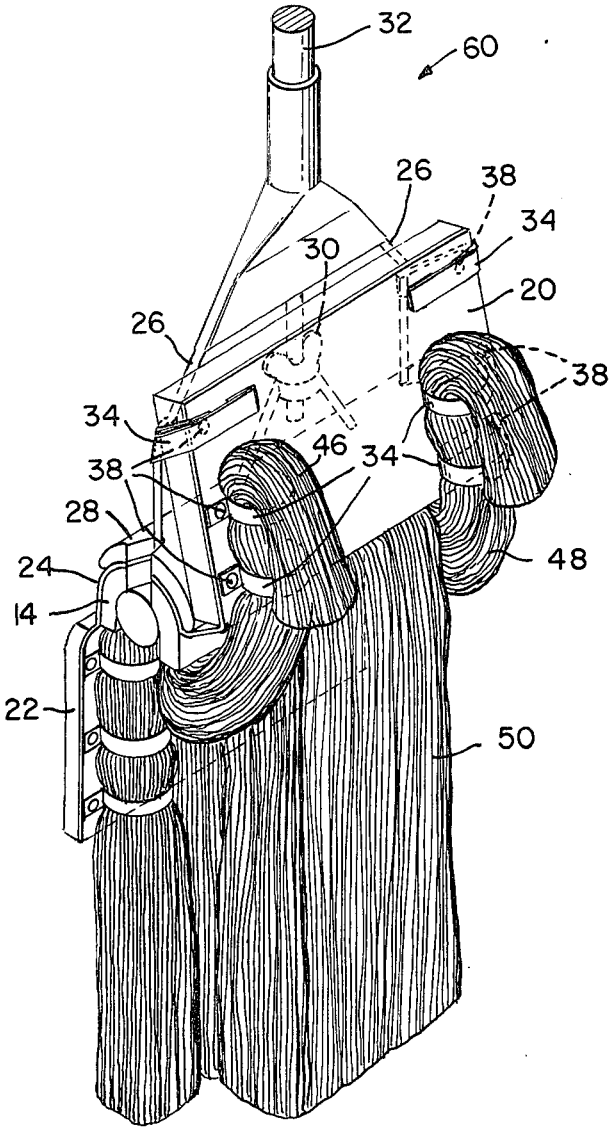
FIG. 4
FIG. 5
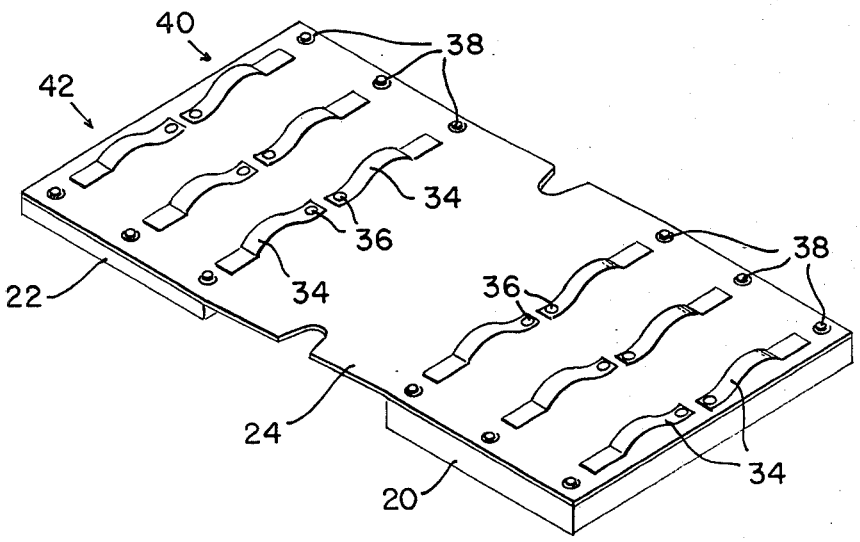

WASHING, POLISHING AND SCRUBBING MOP

PRIOR ART

This invention relates generally to a mop attachment, and more particularly to an arrangement of a mop swab with attachments which together form a mop that improves the efficiency of floor cleaning by enabling performance of a washing, scrubbing and polishing action. In a study of floor mop cleaning devices, in addition to inventing and obtaining a U.S. Pat. No. 3,432,873, as well as obtaining a thorough patent search in this field, it appears that the present invention is new and an improvement over existing mop attachments and mop structures.

Several patents of interest have been discovered, such as:

U.S. Pat. No. 1,576,777
U.S. Pat. No. 1,643,878
U.S. Pat. No. 1,676,880
U.S. Pat. No. 3,135,002
U.S. Pat. No. 3,432,873
U.S. Pat. No. 3,795,934
U.S. Pat. No. 3,805,315 and
French Pat. No. 1,023,751.

Upon a thorough review, it appears that U.S. Pat. Nos. 3,432,873 and 3,795,934 are most pertinent. In U.S. Pat. No. 3,795,934, the improvement is a permanently attached headband which is made of abrasive material for scrubbing purposes, and U.S. Pat. No. 3,432,873 discloses permanently connected abrasive strips or cones and also removably connected abrasive attachments.

The features provided in the above-mentioned patents are improvements to the conventional mop, but fall short of the special additional features which are obtained in the present invention.

The present invention incorporates the above improvements but also provides for an additional polishing action. Furthermore, the scrubbing and polishing action is clearly visible by color coded pads. The present invention employs rectangular pads mounted in a fashion to provide even pressure from substantially most of the flat pad surface to the floor surface. Furthermore, the attachment system of the pads provides for various mounting arrangements so that either none, one, or both pads are utilized, thus providing a choice of washing, scrubbing, or polishing, or a combination thereof.

The above prior art devices, in particular the scrubbing attachments shown in U.S. Pat. No. 3,432,873, require a specially designed handle and a ring retainer or fastener structure not available on the commercial market. However, the most important asset of the present invention is the ability to maneuver the mop with scrubbing and polishing action exactly along floor boards, difficult sides, and floor obstrusions, which particular maneuvering or handling feature is not disclosed in the prior art.

Other features shall be described and recognized from the following description.

IN THE DRAWINGS

FIG. 4 is an isometric view of the same mop shown in FIG. 3, however, the scrubbing/polishing attachment is folded and connected in an upward position for providing a washing action only.

FIG. 5 illustrates the inside surface of the scrubbing-/polishing attachment and its tabs and snap buttons.

DETAILED DESCRIPTION AND OPERATION OF THE INVENTION

Figure 1:
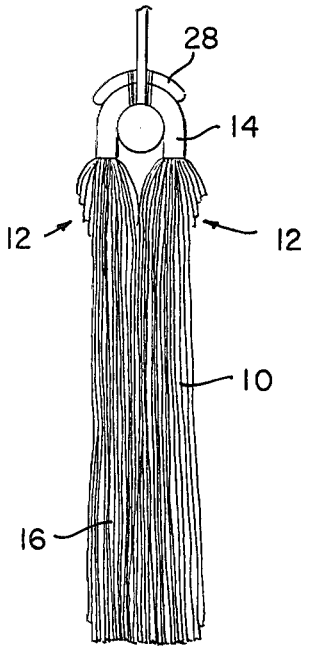
FIG. 1 PRIOR ART
FIG. 1 is a side view of a conventional mop, and in particular points out the area of wear near the headband.

Before describing the specific details of the invention, attention if requested to FIG. 1 which illustrates the worn areas of the mop swab 10 at the locations 12, indicated by an arrow just under the headband 14 of the mop swab 10. In general, the strands 16 of the mop swab 10 are worn and eventually break at the area 12 which is the area that comes in contact with the floor first, particularly in the pulling stroke, enduring the dry and dirty rupture action at the floor surface causing severe damage to the strands.

Of course, this problem has been recognized in the prior art and solutions, such as a wider headband which forms an apron at the area 12, have been proposed.

Figure 8:
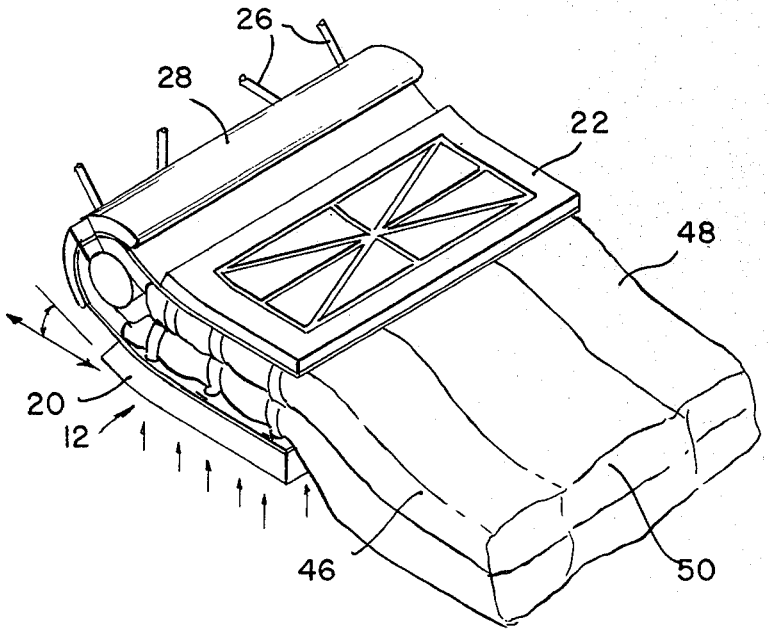
FIG. 8 shows only one-half of the scrubbing/polishing attachment but portrays the even pressure at the floor surface of the pad.

The present invention, however, carries this contact area over a portion of the pads 20 or 22 at a similar pulling angle as indicated in FIG. 8. Furthermore, the length of the pad is about half the length of the mop so that a larger area of toughness is in contact with the floor, saving the mop strands over a larger area. Thus, the present invention offers greater wear protection and has factually proven to extend mop life for over three times the normal 12 to 16 hours of conventional mop life. As a matter of fact, the pads 20 and 22 have a longer wear time than the strands 16 of the mop swab 10.

Figure 2:
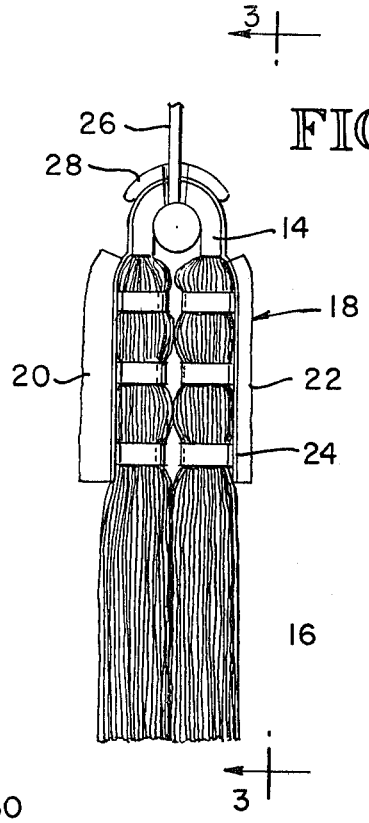
FIG. 2 is a side view of a conventional mop and mop holding structure provided with the preferred polishing and scrubbing features and attachments.
Figure 3:
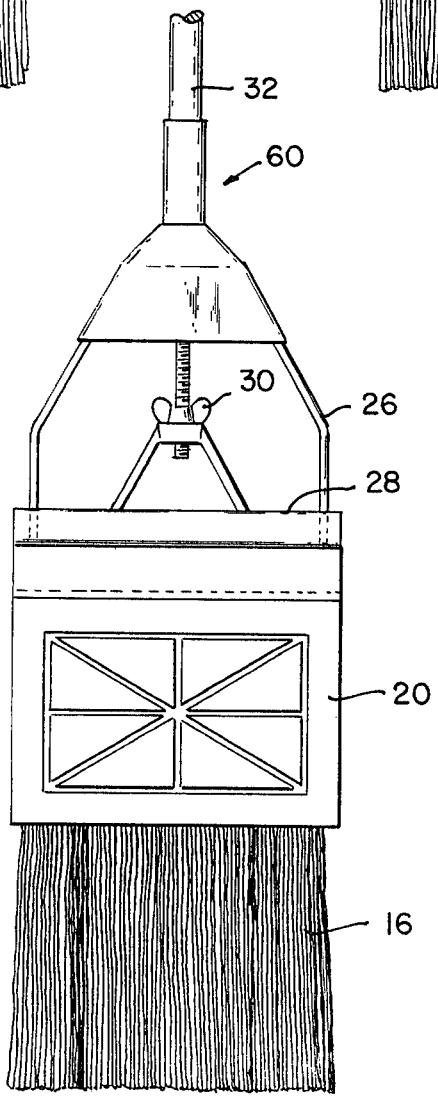
FIG. 3 is a front view taken from FIG. 2 along the line 3—3.
Figure 6:
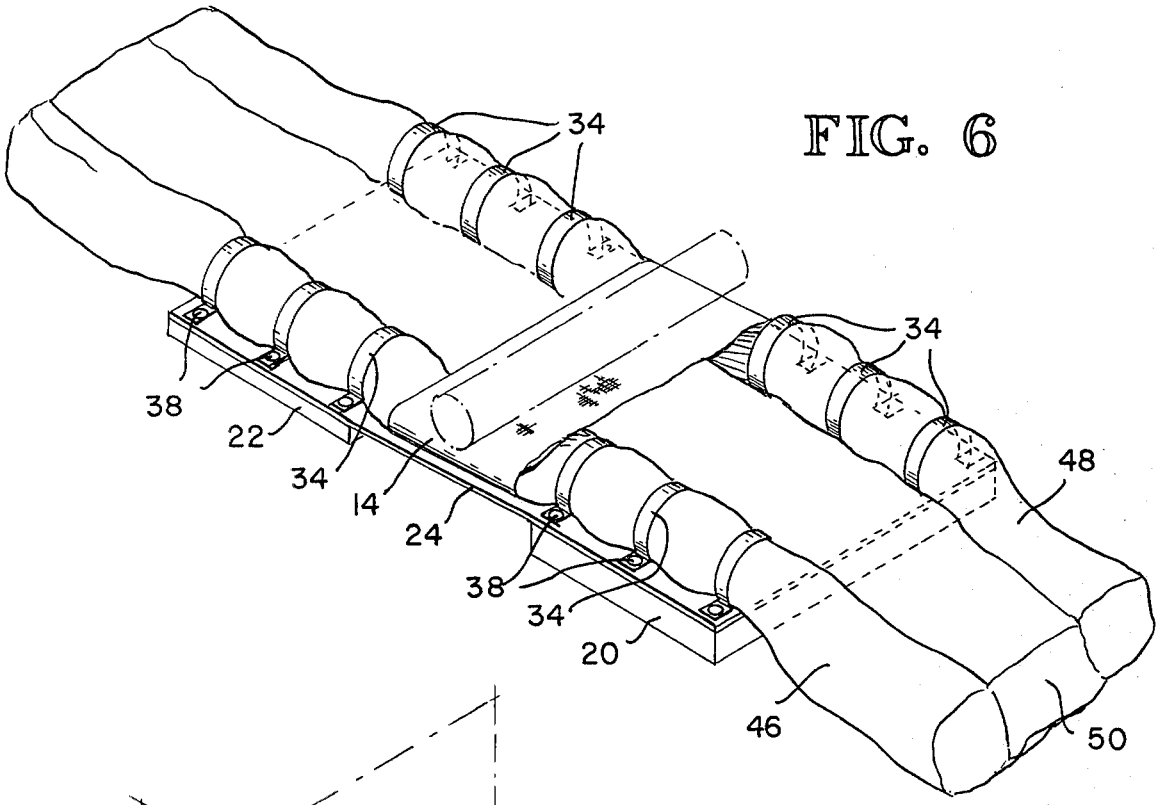
FIG. 6 illustrates the same inside surface of the scrubbing/polishing attachment but with the mop swab attached thereto in a particular predetermined arrangment.

In FIGS. 2 and 3, the side and front view of the mop attachment 18 shows a carrying cloth 24 of substantial rectangular configuration. The cloth, which may be of flexible linen or other tough, strong material 24 has a fold line 26 or area that bends over the headband 14 and, as illustrated in FIGS. 2 and 3, mounts the attachment 18 to the mop holding mechanism 26, which is conventional, utilizing a pressure bar 28 with wing nut 30. The mechanism 26 is connected to the handle 32. Referring now to FIGS. 5 and 6 of the inside fold-in surface of the rectangular carrying cloth 24, a plurality of tabs 34 and male and female snap button components 36 and 38, respectively, are connected and arranged therein.

These tabs 34 form two rows 40 and 42 which are parallel to the longest edges of the rectangular cloth 24.

Accordingly, these tabs 34 are utilized to bundle part of the mop swab 16 so that each pad 20–22 is partly attached thereto. Thus, as illustrated in FIG. 2, the tabs 34 are connected about a bundle of the outside mop swab strands.

In FIG. 6, the mop swab 16 is clearly shown to be separated into three bundles 46, 48 and 50. It appeared upon testing and after many hours of practicing and trial that, for example, a 350-strand mop swab should be divided into 50-250-50 bundles 46, 50 and 48, respectively.

Upon soaking the mop assembly 60 into washing water, the mop swab 16 becomes very heavy and compact and holds the pads 20 and 22 perfectly next to the mop swab 16.

Upon placing the mop 60 unto the floor, the pads 20 or 22 will flatly and evenly, with substantially a heavy, waterlogged weight parameter, cling to the floor. A surprising yet factual strong scrubbing action is followed by washing in the pulling stroke and by washing and scrubbing in the pushing stroke.

Sometimes a soaking or washing action just to wet the floor and the dirt is preferred, and therefore, the attachment 18 can be folded away or tightened upwards against the mop mechanism 26 as illustrated in FIG. 4.

Other manipulations are possible and accordingly, one can have either the rough pad 20 or the semi-rough pad 22 in the up or the down position.

Figure 7:
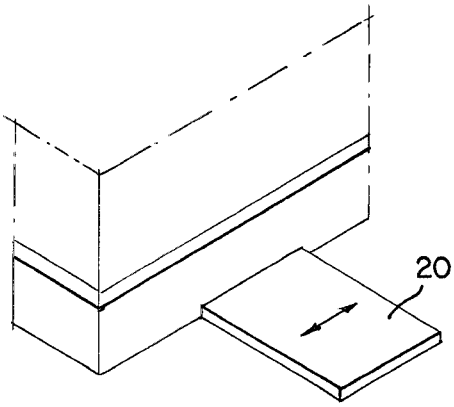
FIG. 7 is a symbolic showing of a pad scrubbing or polishing along a wall baseboard and wherein the additional components of the attachment and mop swab are deleted in order to illustrate the exact cleaning feature of the mop and its maneuverability.

Finally, as illustrated in FIG. 7, the mop 60 maneuverability presents an advantageous improvement which is not possible with existing mops.

Normally, a mop cleaning action provides for a general, overall floor cleaning accomplishment, however, removing food stains, surplus hardened waxes on tile, etc., would require that one use a manual scrubbing pad at spot locations, particularly along floor boards and other difficult to reach areas.

A thorough cleaning of a large floor would require extensive time when using conventional devices. With the present invention, this can be accomplished in a much shorter time period. The above disclosed invention has an amazing scrubbing action which removes large particles easily and thereafter provides for an even, shining cleaning of the surface area by the newly disclosed extra fine polishing action of the semi-rough or fine abrasive pad 22. This third feature of polishing should not be considered lightly because in an exhibition of cleaning tiles where wax residues and other dirt particles were adhered to the tiles, the shining, or semi-rough, pad action caused, after the rough cleaning pad action, a polishing action that made the tiles shine. As a matter of fact, it was believed that the tiles had been re-waxed and polished or buffed, which was not the case.

The above construction tabs 34, snap buttons 36–38 are utilized in the preferred developed invention. However, it should be realized that various other types of fastening means 34 for attachment of the cloth 24 to the bundles 46 and 48 can be utilized.

The abrasive pads 20 and 22 are commercially available and are normally fabricated from materials such as fiberglass, nylon, fibers, etc.

It is deemed unnecessary to present other types of arrangements since those will be obvious after the herein presented configuration, as claimed hereinafter:

1. A washing, scrubbing and polishing mop comprising in combination:
   (a) an elongated handle,
   (b) a mop holding mechanism connected to said handle,
   (c) a mop swab retained in said mechanism,
   (d) a first and a second abrasive pad,
   (e) a rectangular shaped cloth retained by said mechanism on top of said mop swab and extending at front and back sides of said mop swab,
   (f) fastening means connected to said cloth bottom surface fastening said mop swab to said cloth at said front and said back sides, and
   (g) said first pad connected to said cloth upper surface at said mop swab front side and said second pad connected to said cloth upper surface at said mop swab back side.

2. A washing, scrubbing and polishing mop as claimed in claim 1 wherein said first pad is abrasive and said second pad is semi-abrasive to form a scrubbing and polishing feature, respectively.

3. A washing, scrubbing and polishing mop as claimed in claim 2 wherein said fastening means are a plurality of tabs having snap button arrangement for fastening to said mop swab.

4. A washing, scrubbing and polishing mop as claimed in claim 3 wherein said plurality of tabs having snap button arrangement are disposed in two rows to said cloth bottom surface so that each row fastens said mop swab at said front and said back vertical sides.

5. A washing, scrubbing and polishing mop as claimed in claim 4 wherein said cloth extends approximately half the length of said mop swab at said front and at said back.

6. A washing, scrubbing and polishing mop as claimed in claim 5 wherein said cloth extending at said mop swab front can be folded upwards against said holding mechanism and fastened thereto by said fastening means.

7. A washing, scrubbing and polishing mop as claimed in claim 5 wherein said cloth extending at said mop swab back can be folded upwards against said holding mechanism and fastened thereto by said fastening means.

8. A washing mop swab with scrubbing and polishing attachment comprising in combination:
   (a) a mop,
   (b) a substantially rectangular shaped cloth material having a center fold dividing said cloth in substantially equal halves,
   (c) a pair of abrasive pads, each of said pads fastened to said rectangular shaped cloth upper surface so that said pads are at parallel spaced relationship to one another next to said center fold and covering each half of said cloth,
   (d) a plurality of spaced mop fastening means forming two rows, each row located parallel to said rectangular cloth longest edge and each said mop fastening means connected to said rectangular cloth bottom surface, and
   (e) said fastening means arranged to fasten a part of said mop swab to said cloth at said mop swab sides.

* * * * *